US008894780B2

(12) United States Patent
Nuetzel et al.

(10) Patent No.: US 8,894,780 B2
(45) Date of Patent: Nov. 25, 2014

(54) NICKEL/IRON-BASED BRAZE AND PROCESS FOR BRAZING

(75) Inventors: Dieter Nuetzel, Hainburg (DE); Thomas Hartmann, Altenstadt (DE)

(73) Assignee: Vacuumschmelze GmbH & Co. KG, Hanau (DE)

( * ) Notice: Subject to any disclaimer, the term of this patent is extended or adjusted under 35 U.S.C. 154(b) by 1566 days.

(21) Appl. No.: 11/898,653

(22) Filed: Sep. 13, 2007

(65) Prior Publication Data

US 2008/0063903 A1 Mar. 13, 2008

Related U.S. Application Data

(60) Provisional application No. 60/825,578, filed on Sep. 13, 2006.

(51) Int. Cl.
*C22C 19/03* (2006.01)
*B23K 31/02* (2006.01)

(52) U.S. Cl.
USPC ..... 148/426; 228/245; 420/459; 420/452

(58) Field of Classification Search
USPC ..... 148/426; 228/245; 420/459, 452
See application file for complete search history.

(56) References Cited

U.S. PATENT DOCUMENTS

| | | | | |
|---|---|---|---|---|
| 2,880,086 | A | 3/1959 | Cape | |
| 3,303,024 | A * | 2/1967 | Cape | 420/452 |
| 4,302,515 | A | 11/1981 | DeCristofaro et al. | |
| 4,402,742 | A * | 9/1983 | Pattanaik | 420/50 |
| 4,410,604 | A | 10/1983 | Pohlman et al. | |
| 4,444,587 | A | 4/1984 | Kelly | |
| 4,473,401 | A | 9/1984 | Masumoto et al. | |
| 4,516,716 | A | 5/1985 | Coad | |
| 4,528,247 | A | 7/1985 | Mizuhara | |
| 4,543,135 | A | 9/1985 | Bose et al. | |
| 4,745,037 | A | 5/1988 | DeCristofaro et al. | |
| 4,801,072 | A * | 1/1989 | Henschel | 228/245 |
| 4,900,638 | A | 2/1990 | Emmerich | |
| 4,913,752 | A | 4/1990 | Falk | |
| 5,102,031 | A * | 4/1992 | Heitman et al. | 228/175 |
| 5,183,636 | A | 2/1993 | DuBois | |
| 5,855,933 | A | 1/1999 | Schmetz | |
| 6,656,292 | B1 | 12/2003 | Rabinkin et al. | |
| 7,255,157 | B2 * | 8/2007 | Richardson | 165/163 |
| 7,276,128 | B2 | 10/2007 | Herzer et al. | |
| 2004/0056074 | A1 | 3/2004 | Sjodin | |
| 2004/0184945 | A1 | 9/2004 | Sjodin | |
| 2006/0090820 | A1 | 5/2006 | Rabinkin et al. | |
| 2007/0175545 | A1 | 8/2007 | Urata et al. | |
| 2008/0318082 | A1 | 12/2008 | Hartmann et al. | |
| 2009/0130483 | A1 | 5/2009 | Hartmann et al. | |

FOREIGN PATENT DOCUMENTS

| | | | |
|---|---|---|---|
| DE | 1059191 | | 6/1959 |
| DE | 2755435 | A1 | 6/1978 |
| DE | 3011152 | A1 | 10/1980 |
| DE | 3929222 | A1 | 3/1991 |
| DE | 4234961 | A1 | 4/1994 |
| DE | 19610539 | A1 | 9/1997 |
| DE | 19805142 | A1 | 8/1999 |
| DE | 69609962 | T2 | 1/2001 |
| DE | 69609962 | T3 | 3/2006 |
| EP | 0042525 | A | 12/1981 |
| EP | 0051461 | A1 | 5/1982 |
| EP | 0057935 | A | 8/1982 |
| EP | 0066356 | A | 12/1982 |
| EP | 0147937 | A1 | 11/1983 |
| EP | 0108959 | A1 | 5/1984 |
| EP | 0127894 | A | 12/1984 |
| EP | 0127894 | A1 | 12/1984 |
| EP | 0342545 | A1 | 11/1989 |
| EP | 0827437 | B2 | 3/1998 |
| EP | 0827438 | B1 | 3/1998 |
| EP | 0 854 002 | A1 | 7/1998 |
| EP | 1347859 | B1 | 10/2003 |
| FR | 1216019 | A | 4/1960 |
| GB | 826780 | | 1/1960 |
| GB | 844835 | | 8/1960 |
| JP | 53-144852 | | 12/1978 |
| JP | 58-155704 | | 9/1983 |
| JP | 59-56991 | | 4/1984 |
| JP | 60-106691 | A | 6/1985 |
| JP | 62-227595 | | 10/1987 |
| JP | 63-079931 | | 4/1988 |
| JP | 63-241135 | A | 10/1988 |

(Continued)

OTHER PUBLICATIONS

ASM International, Materials Park, Ohio, ASM Specialty Handbook: Nickel, Cobalt, and Their Alloys, "Introduction to Nickel and Nickel Alloys", Dec. 2000, pp. 79-85.*

Chemical Abstracts No. 2000:432500 (Rabinkin, A.: "Optimization of brazing technology, structural integrity, and performance of multi-channeled three dimensional metallic structures", XP002463219, in Vianco et al. eds., Advanced Brazing and Soldering Technologies, International Brazing & Soldering Conference Proceedings, American Welding Society, Miami, 2000.

EPO Search Report dated Jan. 16, 2008.

(Continued)

*Primary Examiner* — Jessee Roe

(74) *Attorney, Agent, or Firm* — Dickinson Wright PLLC

(57) ABSTRACT

Disclosed are a braze, such as a braze in the form of an amorphous, ductile brazing foil, having a composition consisting essentially of $Fe_aNi_{rest}Si_bB_cM_d$ with 5 atomic percent≤a≤35 atomic percent, 1 atomic percent≤b≤15 atomic percent, 5 atomic percent<c≤15 atomic percent, 0≤d≤4 atomic percent, rest Ni and incidental impurities, wherein M is one or more of the elements Co, Cr, Mn, Nb, Mo, Ta, Cu, Ag, Pd or C, and having a liquidus temperature $T_L$≤1025° C. Also disclosed are apparatus containing parts joined by said braze, methods for using said braze, and methods for making said amorphous, ductile brazing foil.

13 Claims, 2 Drawing Sheets

(56) References Cited

FOREIGN PATENT DOCUMENTS

| | | | |
|---|---|---|---|
| JP | 2019442 | A | 1/1990 |
| JP | 02 80533 | | 3/1990 |
| JP | 03180425 | A | 8/1991 |
| JP | 2004-114157 | A | 4/2004 |
| JP | 2005-28425 | A | 2/2005 |
| RU | 2 121 520 | C1 | 11/1998 |
| WO | WO 96/37335 | | 11/1996 |
| WO | WO 9734732 | A1 | 9/1997 |
| WO | WO 02/18667 | A2 | 3/2002 |
| WO | WO 02/38327 | A1 | 5/2002 |
| WO | WO 02/098600 | A1 | 12/2002 |
| WO | WO 03/106101 | A1 | 12/2003 |
| WO | WO 2006/050334 | A2 | 5/2006 |
| WO | WO 2006/126953 | A1 | 11/2006 |
| WO | WO 2007/022740 | A1 | 3/2007 |

OTHER PUBLICATIONS

M. Miglierini et al., "Mössbauer and AC susceptibility study of structurally modified Fe-Ni-Cr-Mo-Si-B-type metallic glasses", J. Phys.: Condens, Matter 3, 1991, pp. 2721-2727, XP002405180.

G.D. Zhang et al., "Influence of copper on amorphous nickel based brazing alloy", Science and Technology of Welding and Joining, 2001, vol. 6, No. 2.

Schaffer et al., Part III Microstructural Development, Chapter 7 Phase Equilibria and Phase Diagrams, The Science and Design of Engineering Materials, Second Edition, ISBN: 0-256-24766-8, McGraw-Hill Companies, Inc., 1999, p. 242-245.

* cited by examiner

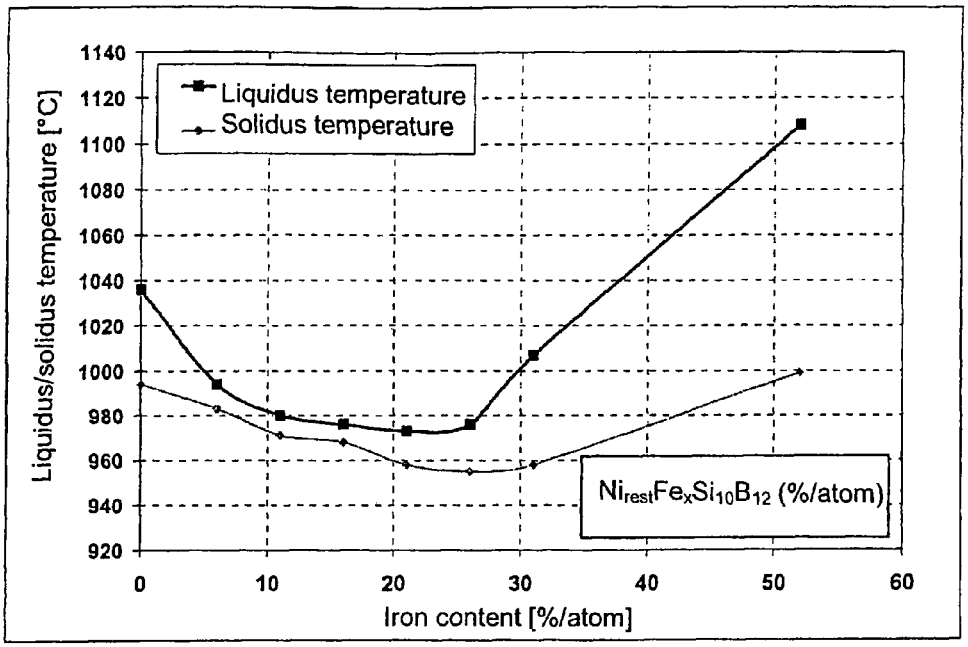
Fig.1: Liquidus and solidus temperatures of at least partially amorphous brazing foils produced with rapid solidification technology with a composition of $Ni_{rest}Fe_xSi_{10}B_{12}$ (composition in %/atom)

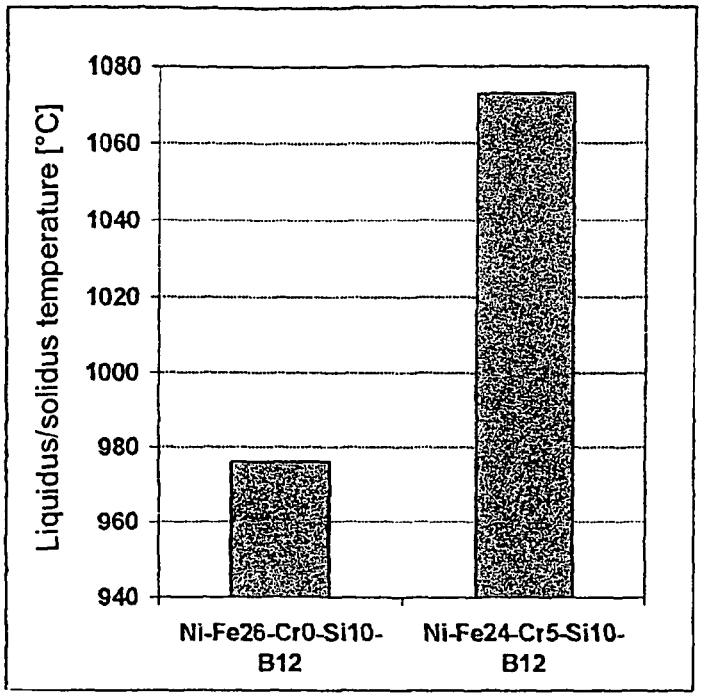
Fig.2: Liquidus temperature of Ni/Fe brazing foils with 0 and 5 %/atom chromium

NICKEL/IRON-BASED BRAZE AND PROCESS FOR BRAZING

This application claims benefit of the filing date of U.S. Provisional Application Ser. No. 60/825,578, filed Sep. 13, 2006, the entire contents of which are incorporated herein by reference.

BACKGROUND

1. Field

The invention relates to a nickel/iron-based braze and a process for brazing two or more parts.

2. Description of Related Art

Soldering is a process for joining metal or ceramic parts using a molten filler material known as solder. A distinction is drawn between soft soldering and brazing (hard soldering) on the basis of the working temperature of the solder, said working temperature typically lying 10° C. to 60° C. above the liquidus temperature of the solder. Soft solders are worked at temperatures below 450° C., whilst brazes are worked at temperatures above 450° C. Brazes are used in applications in which high mechanical stability of the soldered joint and/or high mechanical stability at high operating temperatures are desired.

Brazes have been typically worked at temperatures of approximately 1200° C. In the case of certain parent metals (i.e., the metals being joined together) however, efforts are frequently made to achieve a lower soldering/working temperature for the braze in order to avoid temperature-induced changes in the parent metal.

For example, in the case of steels, coarse grain formation commences at a temperature of 1000° C. and increases significantly as this temperature rises further. Such coarse grain formation is undesirable as it leads to a significant reduction in the mechanical stability of the parent metal.

A low soldering temperature is also desirable in the brazing of precipitation-hardened Ni-based alloys since, in addition to considerable grain coarsening, working temperatures above approximately 1050° C. also lead to an irreversible deterioration in stress rupture strength which cannot be remedied by further heat treatment.

It is also desirable to be able to produce the brazes in various forms such as solder paste and ductile foils, for example, thereby extending the range of application of the brazes.

Certain nickel/iron/chromium-based braze pastes are disclosed in U.S. Pat. No. 4,402,742, for example. However, the liquidus temperatures of these brazes are well above 1000° C. The working temperature is 10° C. to 60° C. above these temperatures and is therefore too hot for certain parent metals. Moreover, the total metalloid content of B and Si is high, and these alloys cannot therefore be produced as ductile foils.

It is therefore desirable to have a nickel-based braze which can be produced in the form of both a solder paste and a ductile foil.

SUMMARY

In one embodiment, is provided a braze having a composition consisting essentially of $Fe_aNi_{rest}Si_bB_cM_d$ wherein 5 atomic percent≤a≤35 atomic percent, 1 atomic percent≤b≤15 atomic percent, 5 atomic percent<c≤15 atomic percent, 0≤d≤4 atomic percent, rest Ni and incidental impurities, and wherein said braze has a liquidus temperature $T_L$≤1025° C. M is one or more of the elements Co, Cr, Mn, Nb, Mo, Ta, Cu, Ag, Pd or C.

The iron content of the braze disclosed in the invention is desirably selected such that the braze has a liquidus temperature $T_L$≤1025° C., preferably less than 1000° C., and more particularly less than 980° C. As a result, the working temperature may be 1050° C. or below. In a more particular embodiment, a braze is provided having an Fe additive content of between 5 atomic percent and 35 atomic percent, preferably between 6 and 31 atomic percent, in the Ni—Si—B system. In this embodiment, M is present in an amount of 0 atomic percent. This iron additive causes a reduction in the liquidus and solidus temperatures compared to the iron-free Ni—Si—B system.

In another embodiment 0<d≤4. In this embodiment, M is present and may be one or more of the elements Co, Cr, Mn, Nb, Mo, Ta, Cu, Ag, Pd or C, and preferably one or more of Nb, Mn, Cr or Mo. The composition of the braze is also selected such that it has a liquidus temperature $T_L$≤1025° C., preferably less than 1000° C., and more particularly less than 980° C. As a result, the working temperature may be 1050° C. or below.

A low liquidus temperature is desirable if the maximum soldering temperature is limited. This is the case in certain industrial soldering processes, for example, and in particular for joining stainless steel parent metals, since undesirable coarse grain formation starts to occur in the parent metal at a temperature of 1000° C. This undesirable coarse grain formation leads to a reduction in the mechanical stability of the parent metal which is critical in certain technical applications such as heat exchangers. This problem is significantly reduced by the braze disclosed herein, which has a liquidus temperature $T_L$ of ≤1025° C.

In another particular embodiment is provided a nickel/iron-based braze with an Fe content of 5 atomic percent≤a≤30 atomic percent and preferably 10 atomic percent<a≤30 atomic percent. The raw material costs of brazes with an increased iron content, such as contained in this embodiment, are reduced as part of the nickel content is replaced by iron.

These brazes can be produced as a powder or solder paste, or using rapid solidification technology as an at least partially amorphous ductile foil. These brazes are also phosphor-free, thereby avoiding the formation of very brittle intermetallic phosphides. The field of application of the brazes disclosed herein is extended, and the solder seams produced using these brazes are reliable in use.

The braze disclosed herein can thus be reliably employed for industrial applications in which the maximum soldering temperature is limited to 1050° C., and can be used both for brazing parts made of temperature-sensitive materials such as precipitation-hardened Ni super alloys such as IN718, for example, and for brazing high-grade stainless steels.

In another embodiment is provided an apparatus comprising two or more parts joined by the braze described herein. The apparatus may include a heat exchanger, a fuel cell, a tool mould, or an injection mould.

In another embodiment is provided a process for joining by fusion two or more parts, comprising:

(a) placing the braze described herein between two or more parts to be joined, wherein said parts have a higher melting temperature than the braze, to form a solder joint;

(b) heating the solder joint to a temperature above the liquidus temperature of the braze;

(c) cooling the solder joint to form a brazed connection between the parts to be joined.

In another embodiment is provided a process for producing an at least partially amorphous, ductile brazing foil, comprising:

(a) providing a molten mass consisting essentially of $Fe_aNi_{rest}Si_bB_cM_d$ wherein 5 atomic percent≤a≤35 atomic percent, 1 atomic percent≤b≤15 atomic percent, 5 atomic percent<c≤15 atomic percent, 0≤d≤4 atomic percent, rest Ni and incidental impurities, wherein M is one or more of the elements Co, Cr, Mn, Nb, Mo, Ta, Cu, Ag, Pd or C; and (b) rapidly solidifying the molten mass on a moving cooling surface at a cooling speed of over approximately $10^{5}$° C./sec, to produce an amorphous, ductile brazing foil with a liquidus temperature $T_L$≤1025° C.

BRIEF DESCRIPTION OF DRAWINGS

FIG. 1 is a graph that shows the solidus and liquidus temperatures as a function of iron content for brazing foils of different compositions in accordance with a first embodiment disclosed herein.

FIG. 2 is a graph that shows the liquidus temperatures of brazing foils with and without chromium additives in accordance with an embodiment disclosed herein.

DETAILED DESCRIPTION OF SPECIFIC EMBODIMENTS

Boron and silicon are both metalloids and glass-forming elements and, in the appropriate amounts, permit braze to be produced as an amorphous ductile foil. An appropriate content of these elements leads to a reduction in the melting/liquidus temperature. If the content of glass-forming elements is too low, the foils solidify into a crystalline state and are very brittle. If, on the other hand, the content of glass-forming elements is too high, the foils are brittle and cannot be worked further for technical processes.

Moreover, in accordance with certain embodiments disclosed herein, the content of the metalloids is selected such that the alloys can be produced using rapid solidification technology as at least partially amorphous ductile foils. In further embodiments the braze has a Si content of 6≤b≤13 atomic percent and/or a B content of 8≤c≤14 atomic percent.

In further embodiments the braze disclosed in the invention has a liquidus temperature $T_L$≤1000° C. and preferably ≤980° C.

The braze disclosed herein can be produced either as a powder or using a rapid solidification process, for example, as an amorphous ductile foil. The braze disclosed in one of the preceding embodiments can be provided either in the form of a solder paste or in the form of an amorphous, ductile brazing foil. These brazes can thus be produced in various forms which can be adapted for different applications and used in a wide range of fields.

In an embodiment the brazing foil is at least 50% amorphous and preferably at least 80% amorphous.

The brazing foils disclosed herein can be produced in thicker strip thicknesses and larger strip widths than other ductile foils. The brazing alloys disclosed herein are thus particularly suitable for casting with thicknesses of more than 20 μm, preferably 20 μm≤D≤100 μm, preferably 40 μm≤D≤100 μm, and with widths of more than 20 mm and 20 mm≤B≤200 mm. This is possible only to a very limited extent with the nickel-based brazing alloys known from the prior art.

An embodiment provides for a heat exchanger which has at least one solder seam produced with a braze with a composition consisting essentially of $Fe_aNi_{rest}Si_bB_cM_d$ with 5 atomic percent≤a≤35 atomic percent, 1 atomic percent≤b≤15 atomic percent, 5 atomic percent<c≤15 atomic percent, 0≤d≤4 atomic percent, rest Ni and incidental impurities. The liquidus temperature $T_L$ is ≤1025° C. M is one or more of the elements Co, Cr, Mn, Nb, Mo, Ta, Cu, Ag, Pd or C.

In a further embodiment this solder seam is produced using a braze of this composition which is produced in the form of an amorphous, ductile brazing foil. For example, a heat exchanger may have at least one solder seam produced using a braze or an amorphous, ductile brazing foil in accordance with one of the preceding embodiments. The solder seam produced using an amorphous, ductile brazing foil has a thickness of at least 20 μm.

The solder seam made of an amorphous, ductile brazing foil differs from a solder seam which is produced using crystalline powder in the size of the B and Si hard phases.

A process is disclosed for joining by fusion two or more parts, comprising the following steps. A braze in accordance with one of the preceding embodiments is placed between two or more metal parts to be joined. The parts to be joined have a higher melting temperature than the braze and may be made, e.g., of stainless steel, a Ni alloy, a Co alloy, copper or a Cu alloy. The solder joint is heated to a temperature above the liquidus temperature of the braze and cooled to form a brazed joint between the parts to be joined.

A further process is disclosed for joining by fusion two or more parts, comprising the following steps. An amorphous, ductile brazing foil in accordance with one of the preceding embodiments is placed between two or more metal parts to be joined. The parts to be joined have a higher melting temperature than the brazing foil and may be made of stainless steel, a precipitation-hardened Ni-based alloy, a Ni alloy, a Co alloy, copper or a Cu alloy. The solder joint is heated to a temperature above the liquidus temperature of the brazing foil and cooled to form a brazed joint between the parts to be joined.

The parts to be joined are preferably parts of a heat exchanger or a component of a fuel cell or a tool mould or injection mould.

The brazes and brazing foils disclosed in the invention can be used to make one or more solder seams in an object. The brazed object may be a heat exchanger, a component of a fuel cell or an internal combustion engine or a tool mould or injection mould.

In an embodiment of the process, the brazing alloys disclosed in the invention are manufactured by means of rapid solidification as amorphous, homogenous and ductile brazing foils. This produces a molten metal mass consisting of $Fe_aNi_{rest}Si_bB_cM_d$ with 5 atomic percent≤a≤35 atomic percent, 1 atomic percent≤b≤15 atomic percent, 5 atomic percent<c≤15 atomic percent, 0≤d≤4 atomic percent, rest Ni and incidental impurities. M is one or more of the elements Co, Cr, Mn, Nb, Mo, Ta, Cu, Ag, Pd or C. This molten mass is injected through a casting nozzle onto at least one rapidly rotating casting wheel or casting drum and cooled at a cooling rate of over $10^{5}$° C./sec. The cast strip is then typically removed from the casting wheel at a temperature of between 100° C. and 300° C. and wound directly into a coil or onto a coil former to create an amorphous, ductile brazing foil with a liquidus temperature $T_L$≤1025° C.

In a further process, amorphous brazing foils are used to join by fusion two or more parts in the following steps:

providing a molten mass consisting of $Fe_aNi_{rest}Si_bB_cM_d$ with 5 atomic percent≤a≤35 atomic percent, 1 atomic percent≤b≤15 atomic percent, 5 atomic percent<c≤15 atomic percent, 0≤d≤4 atomic percent, rest Ni and incidental impurities, M being one or more of the elements Co, Cr, Mn, Nb, Mo, Ta, Cu, Ag, Pd or C, rapidly solidifying the molten mass on a moving cooling surface at a cooling speed of over approximately $10^{5}$°

C./sec to produce an amorphous brazing foil with a liquidus temperature $T_L \leq 1025°$ C., forming a solder joint by placing the brazing foil between the metal parts to be joined, heating of the solder joint to a temperature above the liquidus temperature of the brazing foil, cooling of the solder joint to form a connection between the metal parts to be joined.

The liquidus temperature of the brazes disclosed in the invention may be less than 1000° C. and preferably less than 980° C. Using the soldering process disclosed in the invention, it is possible to join by fusion metal parts, in particular metal parts made of low- and mid-alloyed steels, stainless steel and/or nickel alloys, precipitation-hardened Ni-based alloys and/or Co alloys, which are subject to undesirable thermally induced changes such as coarse grain formation, for example, at temperatures above 1000° C. The associated deterioration of the mechanical stability of these parent metals can thus be avoided. Parts typically considered for such processes include those used in the construction of heat exchangers and associated products.

The invention is described in detail below with reference to various illustrative and comparative examples, which are not intended to limit the scope of the invention disclosed herein.

In a first embodiment, Ni-based brazing foils of various compositions are produced using rapid solidification technology. The basic composition is $N_{rest}Fe_xSi_{10}B_{12}$, producing foils with an iron content of 0, 6, 11, 30 16, 21, 26, 31 and 52 atomic percent. The foils are each 25 mm wide and 25 μm thick, and are ductile and at least partially amorphous.

In contrast to pure metals and ideally eutectic alloys, brazing alloys do not melt at one melting point. Rather, depending on their composition, they have a melting interval which is limited by the solidus temperature at which the solder starts to melt and the liquidus temperature at which the solder is completely molten. The ideal working temperature, and thus the ideal soldering temperature of the brazing alloy is typically between 10° C. and 60° C. above the liquidus temperature.

The solidus temperatures and liquidus temperatures of exemplary and comparative brazing foils described above are determined by means of a Differential Scanning Calorimetry (DSC) process and the values are shown in FIG. 1 and Table 1.

Both FIG. 1 and Table 1 show that the reference foil without iron has a liquidus temperature of 1036° C. An iron content of between approximately 5 atomic percent and approximately 35 atomic percent reduces both the solidus temperature and the liquidus temperature. Alloys 2 to 7 in Table I have liquidus temperatures of less than 1025° C. and iron contents of between 6 atomic percent and 31 atomic percent.

At an iron content of 21 atomic percent, the solidus temperature is 958° C. and the liquidus temperature 973° C., and at an iron content of 26 atomic percent the solidus temperature is 955° C. and the liquidus temperature 976° C. At an iron content of 16 atomic percent the solidus temperature is 968° C. and the liquidus temperature 976° C. The lower liquidus temperatures of the foils with iron contents of between 5 atomic percent and 35 atomic percent permit a lower working temperature, and these brazing foils can therefore be used with temperature-sensitive parent metals such as stainless steels and precipitation-hardened Ni super alloys.

When using an iron content of between 5 atomic percent and 35 atomic percent, and preferably between 10 atomic percent and 30 atomic percent, it is possible to specify a Ni-based brazing foil which has a lower working temperature than the working temperature of the iron-free foil. In addition, the raw material costs of the foils are reduced by the replacement of part of the nickel by iron. At the same time, higher B and Si contents are avoided in order to reduce the liquidus and working temperatures and thereby avoid the occurrence of a brittle solder seam due to a high metalloid content. These brazing alloys are also phosphor-free, thereby avoiding the formation of undesirable brittle intermetallic phosphides in the solder seam.

In a second embodiment, various nickel/iron-based brazing alloys and nickel/iron/chromium-based brazing foils are produced.

The alloys in the second embodiment are produced using rapid solidification technology and the foils thus produced are 25 mm wide and 25 μm thick, and are ductile and at least partially amorphous.

The liquidus temperatures of the foils are determined using a DSC process. FIG. 2 and Table 2 show the liquidus temperatures of two foils. The first foil has a composition of $Ni_{52}Fe_{26}Si_{10}B_{12}$ and is thus chromium-free. The second foil has a composition of $Ni_{49}Fe_{24}Cr_5Si_{10}B_{12}$ and thus contains 5 atomic percent chromium. The liquidus temperature of the first brazing foil without chromium is 975° C. and the liquidus temperature of the second brazing foil with 5 atomic percent chromium is 1075° C. A liquidus temperature of 1075° C. results in a working temperature which brings about significant changes in the properties of many materials to be soldered during the joining process, including coarse grain formation and reduced mechanical stability, for example.

In a third embodiment, brazing foils with a composition of $Ni_{rest}Fe_{25}Si_{11}B_{11}M_1$ are produced using rapid solidification technology, wherein M is one of the elements Nb, Mn, Cr or Mo. The foils produced have 1.0 atomic percent Nb, Mn, Cr or Mo. A reference foil with a composition of $Ni_{res}Fe_{25}Si_{11}B_{11}$ is also produced. The foils are each 25 mm wide and 25 μm thick, and are ductile and at least partially amorphous.

The solidus temperatures and liquidus temperatures of the brazing foils described above are determined using a Differential Scanning Calorimetry (DSC) process and the values are shown in Table 3.

The liquidus temperatures of each of the four alloys 2 to 5 are less than 1000° C. The desired low liquidus temperature provided with the binary alloy 1 with a composition of $Ni_{rest}Fe_{25}Si_{11}B_{11}$ is retained.

In the case of alloy 3 which has a Mn content of 1.0 atomic percent, the liquidus temperature of 970° C. is somewhat lower than the liquidus temperature of the reference foil 1 at 973° C. Additives of 1.0 atomic percent Nb, Cr or Mo produce a liquidus temperature of 975° C. which is only 2 degrees higher than the liquidus temperature of reference foil 1.

TABLE I

Liquidus and solidus temperatures of at least partially amorphous brazing foils produced using rapid solidification technology with a composition of $Ni_{res}Fe_xSi_{10}B_{12}$.

| Alloy | Ni (%/at) | Fe (%/at) | Si (%/at) | B (%/at) | Solidus temperature (° C.) | Liquidus temperature (° C.) |
|---|---|---|---|---|---|---|
| 1 | rest | 0 | 10 | 12 | 994 | 1036 |
| 2 | rest | 6 | 10 | 12 | 983 | 994 |
| 3 | rest | 11 | 10 | 12 | 971 | 980 |
| 4 | rest | 16 | 10 | 12 | 968 | 976 |
| 5 | rest | 21 | 10 | 12 | 958 | 973 |
| 6 | rest | 26 | 10 | 12 | 955 | 976 |
| 7 | rest | 31 | 10 | 12 | 958 | 1007 |
| 8 | rest | 52 | 10 | 12 | 999 | 1108 |

TABLE 2

Liquidus temperature of Ni—Fe brazing foils with Cr contents of 0 and 5 atomic percent.

| Alloy | Composition (%/atom) | Liquidus temperature (° C.) |
|---|---|---|
| 1 | $Ni_{rest}$—$Fe_{26}$—$Cr_0$—$Si_{10}$—$B_{12}$ | 975 |
| 2 | $Ni_{rest}$—$Fe_{24}$—$Cr_5$—$Si_{10}$—$B_{12}$ | 1075 |

TABLE 3

Liquidus and solidus temperatures of at least partially amorphous brazing foils produced using rapid solidification technology with the composition $Ni_{rest}Fe_{25}Si_{10}B_{12}M_1$.

| Alloy | Ni (%/at) | Fe (%/at) | Si (%/at) | B (%/at) | M (%/at) | Solidus Temperature (° C.) | Liquidus temperature (° C.) |
|---|---|---|---|---|---|---|---|
| 1 | rest | 25 | 11 | 11 | 0 | 955 | 973 |
| 2 | rest | 25 | 11 | 11 | 1.0 Nb | 955 | 975 |
| 3 | rest | 25 | 11 | 11 | 1.0 Mn | 950 | 970 |
| 4 | rest | 25 | 11 | 11 | 1.0 Cr | 966 | 975 |
| 5 | rest | 25 | 11 | 11 | 1.0 Mo | 962 | 975 |

The invention has been described above with reference to certain specific embodiments and examples; it will be recognized that these specific embodiments and examples are provided to aid in understanding the invention, are exemplary only, and do not limit the scope of the appended claims.

The invention claimed is:

1. An apparatus comprising two or more parts joined by a braze comprising:

a composition consisting essentially of:

$$Fe_aNi_{rest}Si_bB_cM_d$$

wherein approximately 10 atomic percent≤a≤approximately 35 atomic percent, 1 atomic percent≤b≤15 atomic percent, 5 atomic percent<c≤15 atomic percent, 0≤d≤4 atomic percent, rest Ni and incidental impurities, wherein M is one or more of the elements Co, Cr, Mn, Nb, Mo, Ta, Cu, Ag, Pd or C; and wherein said braze has a liquidus temperature $T_L$≤1025° C. and has been formed from an at least 50% amorphous, ductile brazing foil having a thickness D, where 10 μm≤D≤100 μm, wherein the apparatus comprises a heat exchanger or a component thereof having at least one solder seam produced with said braze.

2. The apparatus in accordance with claim 1, wherein the Si content is such that 6 atomic percent≤b≤13 atomic percent.

3. The apparatus in accordance with claim 1, wherein the B content is such that 8 atomic percent≤c≤14 atomic percent.

4. The apparatus in accordance with claim 1, wherein the Fe content is such that 10 atomic percent≤a≤30 atomic percent.

5. The apparatus in accordance with claim 1, wherein the liquidus temperature $T_L$≤1000° C.

6. The apparatus in accordance with claim 5, wherein the liquidus temperature $T_L$≤980° C.

7. The apparatus in accordance with claim 1, wherein said thickness D is 40 μm≤D≤100 μm.

8. The apparatus in accordance with claim 1, wherein the brazing foil has a width B, where 20 mm≤B≤200 mm.

9. The apparatus in accordance with claim 8, wherein said width B is 40 mm≤B≤200 mm.

10. The apparatus according to claim 1, wherein said braze is a brazing foil, and wherein said solder seam has a thickness >20 μm.

11. The apparatus in accordance with claim 1, wherein said heat exchanger is a component of a fuel cell.

12. The apparatus in accordance with claim 1, wherein M is one or more of the elements Co, Cr, Mn, Nb, Mo, Ta, Cu, Ag, or Pd.

13. An apparatus comprising two or more parts joined by a braze comprising:

a composition consisting essentially of:

$$Fe_aNi_{rest}Si_bB_cM_d$$

wherein approximately 10 atomic percent≤a≤approximately 35 atomic percent, 1 atomic percent≤b≤15 atomic percent, 5 atomic percent<c≤15 atomic percent, 0≤d≤4 atomic percent, rest Ni and incidental impurities, wherein M is one or more of the elements Co, Cr, Mn, Nb, Mo, Ta, Cu, Ag, Pd or C; and wherein said braze has a liquidus temperature $T_L$≤1025° C. and has been formed from an at least 50% amorphous, ductile brazing foil having a thickness D, where 10 μm≤D≤100 μm, wherein said parts comprise one or more of low- or mid-alloyed steel, a stainless steel, an alloy of Co, copper, or a copper alloy, or a precipitation-hardened Ni-based alloy.

* * * * *